US011073069B1

(12) United States Patent
Park et al.

(10) Patent No.: US 11,073,069 B1
(45) Date of Patent: Jul. 27, 2021

(54) VEHICLE THERMAL MANAGEMENT SYSTEM USING TWO-PORT TYPE INTEGRATED THERMAL MANAGEMENT VALVE AND COOLING CIRCUIT CONTROL METHOD OF VEHICLE THERMAL MANAGEMENT SYSTEM

(71) Applicants: Hyundai Motor Company, Seoul (KR); Kia Motors Corporation, Seoul (KR)

(72) Inventors: Cheol-Soo Park, Gyeonggi-do (KR); Jun-Sik Park, Seoul (KR); Bong-Sang Lee, Gyeonggi-do (KR); Dae-Kwang Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/841,476

(22) Filed: Apr. 6, 2020

(30) Foreign Application Priority Data

Jan. 29, 2020 (KR) ..... 10-2020-0010389

(51) Int. Cl.

| | |
|---|---|
| ***F01P 7/14*** | (2006.01) |
| ***F01P 7/16*** | (2006.01) |
| ***F01P 3/18*** | (2006.01) |
| ***F01P 5/10*** | (2006.01) |
| ***F02M 26/22*** | (2016.01) |
| ***F01P 3/02*** | (2006.01) |

(52) U.S. Cl.
CPC ..... *F01P 7/14* (2013.01); *F01P 3/02* (2013.01); *F01P 3/18* (2013.01); *F01P 5/10* (2013.01); *F01P 7/165* (2013.01); *F02M 26/22* (2016.02); *F01P 2003/028* (2013.01); *F01P 2007/146* (2013.01); *F01P 2060/08* (2013.01); *F01P 2060/18* (2013.01)

(58) Field of Classification Search
CPC ..... F01P 7/14; F01P 3/02; F01P 3/18; F01P 5/10; F01P 2003/028; F01P 2007/146; F01P 2060/08; F01P 2060/18; F01P 7/16; F02M 26/22
See application file for complete search history.

(56) References Cited

U.S. PATENT DOCUMENTS

| | | | | |
|---|---|---|---|---|
| 9,188,051 | B1 | 11/2015 | Zahdeh et al. | |
| 2013/0213324 | A1* | 8/2013 | Saitoh | F01P 7/165 123/41.09 |
| 2016/0258341 | A1* | 9/2016 | Yoon | F02M 26/73 |
| 2017/0184008 | A1* | 6/2017 | Nagai | F01P 3/02 |
| 2018/0298806 | A1* | 10/2018 | Sutherland | F01P 3/02 |

* cited by examiner

*Primary Examiner* — Jacob M Amick
(74) *Attorney, Agent, or Firm* — Mintz Levin Cohn Ferris Glovsky and Popeo, P.C.; Peter F. Corless

(57) ABSTRACT

A vehicle thermal management system is provided that includes an integrated thermal management (ITM) valve having a coolant outlet flow path that is connected to each of heat exchangers, which include one or more among a coolant inlet connected to an engine coolant outlet of an engine and into which coolant flows, a heater core, an EGR cooler, an oil warmer, and an ATF warmer, and a radiator and through which the coolant is distributed. A water pump is disposed at the front end of an engine coolant inlet of the engine and a coolant branch flow path is branched at the front end of the engine coolant inlet to be connected to any one of the heat exchangers.

18 Claims, 14 Drawing Sheets

VEHICLE THERMAL MANAGEMENT SYSTEM USING TWO-PORT TYPE INTEGRATED THERMAL MANAGEMENT VALVE AND COOLING CIRCUIT CONTROL METHOD OF VEHICLE THERMAL MANAGEMENT SYSTEM

CROSS-REFERENCE TO RELATED APPLICATION

This application claims priority to Korean Patent Application No. 10-2020-0010389, filed on Jan. 29, 2020, which is incorporated herein by reference in its entirety.

BACKGROUND

Field of the Disclosure

The present disclosure relates to a vehicle thermal management system, and more particularly, to a vehicle thermal management system, which saves costs while reducing the size of an integrated thermal management valve configured to optimize a cooling circuit under a coolant distribution control for the cooling circuit to which an exhaust heat recovery system and a heat exchanger are connected.

Description of Related Art

Generally, a vehicle thermal management system (hereinafter, referred to as VTMS) applies a coolant integrated thermal management valve (hereinafter, referred to as an Integrated Thermal Management Valve) to a cooling circuit control for distributing high temperature engine coolant capable of simultaneously satisfying high fuel efficiency and high performance. The integrated thermal management valve may configure the cooling circuit of the VTMS, thereby effectively distributing engine coolant varying according to vehicle or engine operating conditions.

For example, the integrated thermal management valve has a 4-port outlet together with an inlet for receiving engine coolant, and may connect the VTMS to each of a cooling system, an exhaust gas recirculation (EGR) system, an auto transmission fluid (ATF) system, and a heater system by a 4 port-4 way, thereby maximizing the heat exchange performance and effect of the heat exchanger by high temperature engine coolant according to an engine operating states.

However, the 4-port type integrated thermal management valve has disadvantages in that the size of the cooling circuit of the VTMS is too large for the optimization in terms of the size and the costs thereof is expensive for generalizing the VTMS in terms of the costs. Particularly, it is further required to improve the competitiveness in size and price of the 4-port type integrated thermal management valve in terms of complex and compact engine room layout according to high performance of the engine.

The contents described in this section are merely to help the understanding of the background of the present disclosure, and may include what is not previously known to those skilled in the art to which the present disclosure pertains.

SUMMARY

Accordingly, an object of the present disclosure considering the above point is to provide a vehicle thermal management system using a 2-port type integrated thermal management valve and a cooling circuit control method thereof, which may configure a cooling circuit of a heat exchanger with two ways of an integrated thermal management valve in connection with an exhaust heat recovery system, thereby reducing the size of the valve for optimizing a configuration of the cooling circuit, and particularly, lower the unit price of the valve by switching to the two ways using one ball, thereby enhancing the vehicle mountability while improving the price competitiveness.

A vehicle thermal management system according to the present disclosure for achieving the object may include an ITM configured to receive coolant through a coolant inlet connected to an engine coolant outlet of an engine, and distribute the coolant flowing out through a coolant outlet flow path to a radiator together with a heat exchange system including at least one of a heater core, an EGR cooler, an oil warmer, and an ATF warmer; a water pump disposed at the front end of an engine coolant inlet of the engine; and a coolant branch flow path branched at the front end of the engine coolant inlet to be connected to any one of the heat exchangers.

An exhaust heat recovery system (EHRS) may be disposed in the coolant branch flow path, and the coolant branch flow path may be connected by applying the oil warmer as the heat exchanger. Additionally, the ITM embeds one layer ball, and the layer ball may include a first layer which forms the coolant outlet flow path as two outlet ports, and a second layer which forms the coolant inlet as two inlet ports.

The coolant outlet flow path may include a heat exchanger outlet flow path connected to the heat exchanger, and a radiator outlet flow path connected to the radiator. The heat exchanger outlet flow path may be branched to two flow paths to be connected to the oil warmer or the ATF warmer while being connected to the heater core or the EGR cooler, and the coolant coming from the heat exchanger outlet flow path may be distributed to the two flow paths.

The engine coolant outlet may be classified into an engine head coolant outlet and an engine block coolant outlet. The coolant inlet may be classified into an engine head coolant inlet connected to the engine head coolant outlet and an engine block coolant inlet connected to the engine block coolant outlet. The valve opening of the ITM may be operated so that the openings or closings of the engine head coolant inlet and the engine block coolant inlet are opposite to each other. Additionally, the opening of the engine head coolant inlet may form a parallel flow in which the coolant may be discharged to the engine head coolant outlet inside the engine, and the opening of the engine block coolant inlet may form a cross flow in which the coolant may be discharged to the engine block coolant outlet.

In addition, in a cooling circuit control method of a vehicle thermal management system according to the present disclosure for achieving the object, coolant of an engine circulated from an ITM to a water pump and a radiator may be received through an engine head coolant inlet and an engine block coolant inlet, the coolant flowing out toward a radiator through a radiator outlet flow path may be distributed, the coolant flowing out toward heat exchangers may include one or more among a heater core, an EGR cooler, an oil warmer, an ATF warmer, and an exhaust heat recovery system through a heat exchanger outlet flow path may be distributed, and a coolant branch flow path connected to the water pump may be connected to any one of the heat exchangers, the exhaust heat recovery system (EHRS) may be supplied a coolant flow to the coolant branch flow path, and the coolant flow may be regulated with respect to the oil warmer, and an engine coolant control mode of the vehicle thermal management system may include performing any one of a flow stop control, a micro flow rate control, a heater flow rate control, a fuel efficiency priority control, and a high load control under a valve opening control of the ITM by a valve controller.

Particularly, in the flow stop control, the ITM may be configured to open the engine head coolant inlet while closing all of the engine block coolant inlet, the heat exchanger outlet flow path, and the radiator outlet flow path. In the micro flow rate control, the ITM may be configured to partially open the heat exchanger outlet flow path while opening the engine head coolant inlet and closing both the engine block coolant inlet and the radiator outlet flow path.

In the heater flow rate control, the ITM may be configured to open both the engine head coolant inlet and the heat exchanger outlet flow path while closing both the engine block coolant inlet and the radiator outlet flow path. Additionally, in the fuel efficiency priority control, the ITM may be configured to open both the engine head coolant inlet and the heat exchanger outlet flow path while partially opening the radiator outlet flow path and closing the engine block coolant inlet.

In the high load control, the ITM may be configured to close the engine head coolant inlet while opening all of the engine block coolant inlet, the heat exchanger outlet flow path, and the radiator outlet flow path. The flow stop control, the micro flow rate control, the heater flow rate control, the fuel efficiency priority control, and the high load control may be determined by operating conditions of vehicle operating information. The valve controller may be configured to open the valve opening of the ITM to the maximum cooling location when an engine is stopped.

The cooling circuit control method of the vehicle thermal management system according to the present disclosure implements the following operations and effects.

Firstly, the vehicle thermal management system (VTMS) configures the cooling circuit connected to the exhaust heat recovery system, thereby configuring the optimized cooling circuit even while using the integrated thermal management valve.

Secondly, it may be possible to reduce the number of ports in the cooling circuit control by connecting the exhaust heat recovery system with the heat exchanger, thereby reducing the size of the integrated thermal management valve by about 60% relative to the 4 port-4 way type to be advantageous for optimizing the configuration of the cooling circuit.

Thirdly, it may be possible to lower the unit price of the valve by using the 2 port-2 way type integrated thermal management valve, thereby improving the price competitiveness relative to the existing valve.

Fourthly, it may be possible to enhance the mountability of the vehicle to which the vehicle thermal management system is applied by the small size and low unit price of the 2 port-2 way type integrated thermal management valve.

Fifthly, the cooling circuit control of the vehicle thermal management system may use the coolant flow rate of the exhaust heat recovery system, thereby maintaining the heat exchange performance and effect between the heat exchangers applied to the cooling system, the EGR system, the ATF system, and the heater system which are connected to the vehicle thermal management system and the engine coolant as it is.

BRIEF DESCRIPTION OF THE DRAWINGS

The objects, features and advantages of the present disclosure will be more apparent from the following detailed description in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, exemplary embodiments of the present disclosure will be described in detail with reference to the exemplary accompanying drawings, and since exemplary embodiments are examples and may be implemented in various different forms by those skilled in the art to which the present disclosure pertains, they are not limited to the exemplary embodiments described herein.

Figure 1:
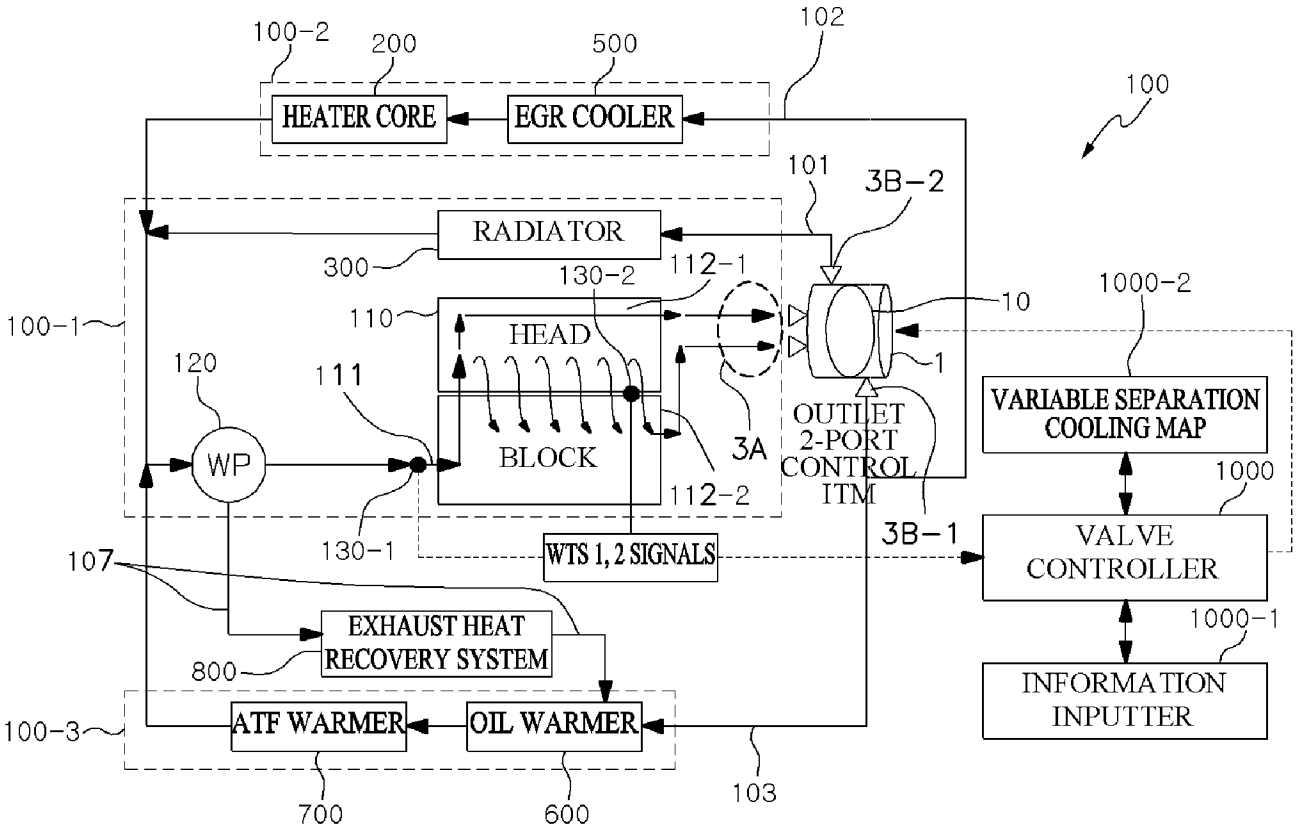
FIG. 1 is a configuration diagram of a vehicle thermal management system using a 2-port type integrated thermal management valve of 2 layers according to an exemplary embodiment of the present disclosure.

Referring to FIG. 1, a vehicle thermal management system 100 (hereinafter, referred to as VTMS) may include an integrated thermal management valve (hereinafter, referred to as ITM) 1 through which the engine coolant of the engine 110 may flow in and out of, cooling circuits 100-1, 100-2, 100-3 through which the engine coolant may be circulated, an exhaust heat recovery system (hereinafter, referred to as EHRS) 800 through which the exhaust gas of the engine 110 may flow, and a valve controller 1000.

Particularly, the EHRS 800 may connect a water pump 120 with any one heat exchanger of a plurality of heat exchangers, which are components of the cooling circuits 100-1, 100-2, 100-3, by a coolant branch flow path 107 to form a coolant branch closed circuit, and may be installed to the front end site of the engine 110. Accordingly, the VTMS 100 may bypass engine coolant to the EHRS 800 through the coolant branch flow path 107 and then transfer the engine coolant to the heat exchangers (e.g., an oil warmer 600 and an ATF warmer 700), thereby simultaneously and rapidly implementing the warm-up for the engine 110 and the engine oil/ATF oil at the initial operation of the engine 110 requiring the increase in temperature.

Hereinafter, the coolant refers to the engine coolant. For example, the ITM 1 may receive the coolant of the engine 110 at two inlet ports by one layer ball 10 embedded in a valve housing and distribute the received coolant at two outlet ports to the cooling circuits 100-1, 100-2, 100-3. Accordingly, the ITM 1 is a 2-port configuration which adjusts a variable flow pattern of the cooling circuit under a control of two outlet ports and has an advantage which may reduce the size of the valve by about 60% while reducing the unit price of the valve relative to the existing 4-port type ITM even while having the same operating performance. For example, the engine 110 is an internal combustion engine, forms an engine coolant inlet 111 disposed at a first side of an engine block (e.g., a cylinder block having a cylinder, a piston, a crankshaft, and the like) as an inlet port into which the coolant flows, and forms the engine coolant outlet 112 disposed at a second side of the engine block (e.g., cylinder block) as an outlet port out which the coolant flows.

Particularly, the engine coolant inlet 111 may be connected to the outlet end of the water pump 120 by a first coolant line 101 of the engine cooling system 100-1. In addition, the engine coolant outlet 112 may be classified into an engine head coolant outlet 112-1 and an engine block coolant outlet 112-2: the engine head coolant outlet 112-1 may be formed on an engine head (e.g., a cylinder head including a cam shaft, a valve system, and the like) to be connected to one of two inlet ports of the ITM 1 (e.g., a first inlet port), and the engine block coolant outlet 112-2 may be formed in an engine block to be connected to the remaining one of two inlet ports of the ITM 1 (e.g., a second inlet port).

Furthermore, the engine 110 may include a first water temperature sensor (WTS) 130-1 and a second water temperature sensor 130-2. The first WTS 130-1 may be configured to detect the temperature of the engine coolant inlet 111 side of the engine 110, and the second WTS 130-2 may be configured to detect the temperature of the engine coolant outlet 112 side of the engine 110, respectively, to transmit the temperatures to the valve controller 1000. Specifically, the cooling circuits 100-1, 100-2, 100-3 may include a coolant circulation system 100-1 configured to decrease the engine temperature by circulating the coolant distributed from the ITM 1, a first coolant distribution system 100-2 having a plurality of heat exchangers through which the coolant distributed from the ITM 1 is circulated, and a second coolant distribution system 100-3 having the plurality of heat exchangers through which the coolant distributed from the ITM 1 is circulated.

In particular, the heat exchanger may include a heater core 200 which increases an outside air temperature by exchanging heat with the engine coolant, a radiator 300 configured to decrease the temperature of the high temperature coolant coming from the engine 110 by exchanging heat with the outside air, an EGR cooler 500 configured to decrease the temperature of the EGR gas of the exhaust gas transmitted to the engine by exchanging heat with the engine coolant, an oil warmer 600 configured to increase the engine oil temperature by exchanging heat with the engine coolant, and an ATF warmer 700 configured to increase the ATF temperature (transmission oil temperature) by exchanging heat with the engine coolant. For example, the coolant circulation system 100-1 may include the water pump 120 configured to pump the engine coolant and a radiator 300 to form the coolant circulation flow, and forms the coolant circulation flow for the water pump 120/the radiator 300/the engine 110 by the first coolant flow path 101 connected to one outlet port of two outlet ports of the ITM 1 (e.g., a first outlet port).

Accordingly, the water pump 120 may connect the coolant branch flow path 107 to a pump housing port or a water pump outlet end to bypass the coolant returned to the engine 110 to the EHRS 800 disposed at the front end of the engine, and applies an electronic water pump to bypass the coolant to the EHRS 800 at the front end of the engine under the control of the valve controller 1000 in a state where the coolant distribution of the ITM 1 is stopped upon the warm-up. The first coolant line 101 may be connected to one outlet port of the two outlet ports of the ITM 1 (e.g., the first outlet port) to form a path in which the coolant coming from the ITM 1 may be transferred to the radiator 300, and may be connected to the oil warmer 600 among the heat exchangers of the second coolant distribution system 100-3 from the water pump 120 through the EHRS 800, thereby enabling the fast warm-up of the engine oil.

For example, the first coolant distribution system 100-2 applies the heater core 200 and the EGR cooler 500 as heat exchangers, and forms the coolant circulation flow for the heater core 200/the EGR cooler 500/the engine 110 by a second coolant flow path 102 connected to the remaining one outlet port of two outlet ports of the ITM 1 (e.g., a second outlet port). Accordingly, the heater core 200 and the EGR cooler 500 may be disposed in series, and the second coolant flow path 102 may be connected to the first coolant flow path 101 connected to the inlet site of the water pump 120 to be joined with the first coolant flow path 101 as one line.

For example, the second coolant distribution system 100-3 applies the oil warmer 600 and the ATF warmer 700 as heat exchangers, and forms the coolant circulation flow for the oil warmer 600/the ATF warmer 700/the engine 110 by a third coolant flow path 103 branched from the second coolant flow path 102 connected to the remaining one outlet port of two outlet ports of the ITM 1 (e.g., the second outlet port). Accordingly, the oil warmer 600 and the ATF warmer 700 may be disposed in series, and the third coolant flow path 103 may be connected to the first coolant flow path 101 connected to the inlet site of the water pump 120 to be joined with the first coolant flow path 101 as one line.

For example, the valve controller 1000 may be configured to perform the coolant flow of the first coolant flow path 101 which circulates the radiator 300 of the coolant circulation system 100-1, the coolant flow of the second coolant flow path 102 which circulates the heater core 200 and the EGR cooler 500 of the first coolant distribution system 100-2, and the coolant flow of the third coolant flow path 103 which circulates the oil warmer 600 and the ATF warmer 700 of the second coolant distribution system 100-3 under the valve opening control of the ITM 1. Additionally, the valve controller 1000 may be configured to perform the coolant bypass flow of the coolant branch flow path 107 joined to the oil warmer 600 and the ATF warmer 700 of the second coolant distribution system 100-3 through the EHRS 800 under a driving control of the water pump 120 in the warm-up conditions.

Accordingly, the valve controller 1000 may be connected to an information input device 1000-1 and a variable separation cooling map 1000-2 for the data sharing via a controller area network (CAN). Particularly, the information input device 1000-1 is an engine controller configured to operate an engine system, and detect ignition (IG) on/off signals, a vehicle speed, an engine load, an engine temperature, a coolant temperature, a transmission oil temperature, an outside air temperature, an ITM operation signal, accelerator/brake pedal signals, and the like to provide the information to the valve controller 1000 as input data to allow the valve controller 1000 to apply, as operating conditions, the vehicle speed, the engine load, the engine temperature, the coolant temperature, the transmission oil temperature, the outside air temperature, and the like.

The variable separation cooling map 1000-2 may include an ITM map which matches the valve opening of the ITM 1 with engine coolant temperature conditions and operating conditions according to the vehicle information. Accordingly, the valve controller 1000 may be operated as a central processing unit configured to output a valve opening signal for adjusting the valve opening of the ITM 1, and implements a program or a logic processing of an algorithm by including a memory as a place storing the logic or the program.

Figure 2:
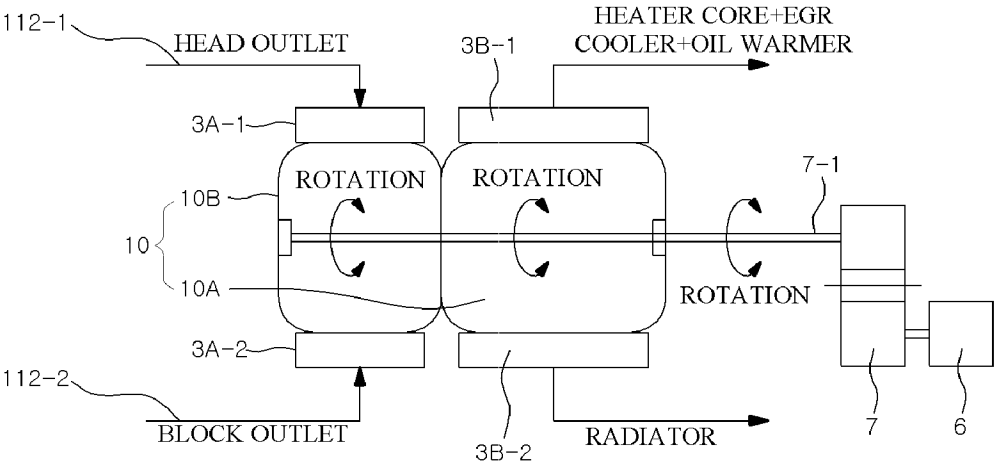
FIG. 2 is a diagram illustrating an example of configuring two layers by one layer ball applied to the integrated thermal management valve according to an exemplary embodiment of the present disclosure.

Meanwhile, FIG. 2 illustrates an example of a detailed configuration of the ITM 1. As illustrated, the ITM 1 may include a valve housing 3 that forms two outlet ports (e.g., a first outlet port and a second outlet port), an actuator 6, a reducer 7, a ball shaft 7-1, and a layer ball 10. For example, the valve housing 3 forms an inner space in which the layer ball 10 is accommodated, and forms two inlet ports for receiving coolant and two outlet ports for discharging the coolant in the inner/outer spaces. Particularly, the valve housing 3 may include a leak aperture to prevent condensate from generating and to improve the temperature sensitivity by supplying the coolant required by the EGR cooler 500 at the initial operation of the engine 110, and the coolant coming from the leak aperture flows into the second coolant flow path 102.

For example, the actuator 6 applies a direct current (DC) or step motor operated by the valve controller 1000, and may be connected to the reducer 7 by a motor shaft. The reducer 7 may include a motor gear which is rotated by a motor and a valve gear which rotates the layer ball 10 by the ball shaft 7-1. For example, the layer ball 10 may include one layer ball classified into a first layer 10A and a second layer 10B, guides the coolant from the engine 110 into the valve housing 3 using two inlet ports in the second layer 10B, and distributes the coolant of the engine 110 to the cooling circuits 100-1, 100-2, 100-3 by using two outlet ports in the first layer 10A.

Accordingly, two outlet ports connected to the first layer 10A form a valve coolant outlet port in the valve housing 3, and the valve coolant outlet port may be classified into a heat exchanger outlet flow path 3B-1 and a radiator outlet flow path 3B-2. Particularly, the heat exchanger outlet flow path 3B-1 may be output from the valve housing 3 as one flow path (that is, line) to be divided (that is, branched) into two flow paths (that is, lines), the two flow paths being each connected to the second coolant flow path 102 of the first coolant distribution system 100-2 and the third coolant flow path 103 of the second coolant distribution system 100-3 whereas the radiator outlet flow path 3B-2 may be output from the valve housing 3 as one flow path (that is, line) to be connected to the first coolant flow path 101 of the coolant circulation system 100-1.

In addition, two inlet ports connected to the second layer 10B form a valve coolant inlet 3A in the valve housing 3, and the valve coolant inlet 3A may each be classified into an engine head coolant inlet 3A-1 connected to the engine head coolant outlet 112-1 and an engine block coolant inlet 3A-2 connected to the engine block coolant outlet 112-2 in the valve housing 3. Accordingly, the coolant circulation system 100-1 may be configured to circulate coolant by transferring the coolant coming from the radiator outlet flow path 3B-2 of the ITM 1 to the radiator 300 through the first coolant flow path 101 under the valve opening control of the valve controller 1000.

The first coolant distribution system 100-2 may be configured to guide the coolant coming from the heat exchanger outlet flow path 3B-1 of the ITM 1 to the EGR cooler 500 and the heater core 200 through the second coolant flow path 102 under the valve opening control of the valve controller 1000, thereby improving heating performance while improving fuel efficiency by shortening the EGR usage time point. In addition, the second coolant distribution system 100-3 may be configured to guide the coolant coming from the heat exchanger outlet flow path 3B-1 of the ITM 1 to the oil warmer 600 and the ATF warmer 700 through the third coolant flow path 103 under the valve opening control of the valve controller 1000 in conditions other than the warm-up, and particularly, guide the bypassed coolant flowing into the coolant branch flow path 107 through the EHRS 800 to the oil warmer 600 and the ATF warmer 700 through the third coolant flow path 103 under the driving control of the water pump 120 of the valve controller 1000 in the warm-up conditions, thereby simultaneously and rapidly improving the warm-up performance by the engine oil/the ATF oil.

Figure 3:
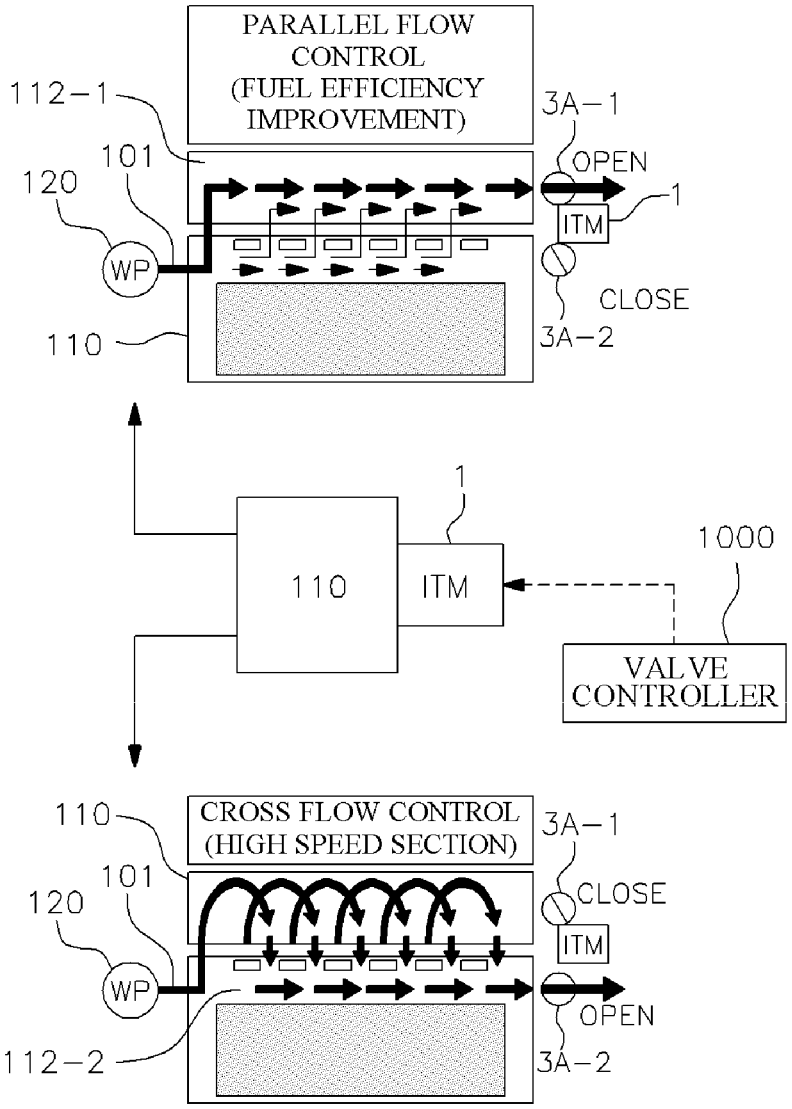
FIG. 3 is a diagram illustrating a state where engine coolant forms a Parallel Flow or a Cross Flow in an engine by the opposite operations between outlet ports of an engine head and an engine block at operation of the integrated thermal management valve according to an exemplary embodiment of the present disclosure.

Meanwhile, FIG. 3 illustrates an example of an engine internal coolant pattern formed by the first layer 10A of the layer ball 10 under the control of the valve controller 1000 for the ITM 1. As illustrated, the engine internal coolant pattern may be classified into a parallel flow (Pf) and a cross flow (CO.

For example, the parallel flow opens the engine head coolant inlet 3A-1 to completely (100%) communicate with the engine head coolant outlet 112-1 whereas closing the engine block coolant inlet 3A-2 to be completely (100%) blocked from the engine block coolant outlet 112-2, thereby being formed to discharge the coolant from the interior of the engine 110 only to the head side. Accordingly, the parallel flow may be applied to improve fuel efficiency by increasing the block temperature of the engine 110. Additionally, the cross flow opens the engine block coolant inlet 3A-2 to completely (100%) communicate with the engine block coolant outlet 112-2 whereas closing the engine head coolant inlet 3A-1 to be completely (100%) blocked from the engine head coolant outlet 112-1, thereby being formed to discharge the coolant from the interior of the engine 110 only to the block side. Accordingly, the cross flow may be applied to improve knocking and durability by decreasing the block temperature of the engine 110.

Particularly, the valve controller 1000 may be configured to adjust the valve opening of the ITM 1 so that a switching range is formed between the parallel flow (Pf) and the cross flow (CO. For example, the switching range may be implemented by a flow pattern control by switching the radiator "0 to 100%" and "100 to 0%" sections in the temperature adjustment section except for a warm-up section and a heating section according to the operating conditions.

Meanwhile, FIGS. 4 to 14 illustrate a cooling circuit control method of the vehicle thermal management system having the VTMS 100 using the 2-port type ITM 1. In particular, the control subject is the valve controller 1000, and the control target may include an operation of each of the water pump 120 and the heat exchanger upon the warm-up based on the ITM 1 by which the valve opening is adjusted.

Figure 4:
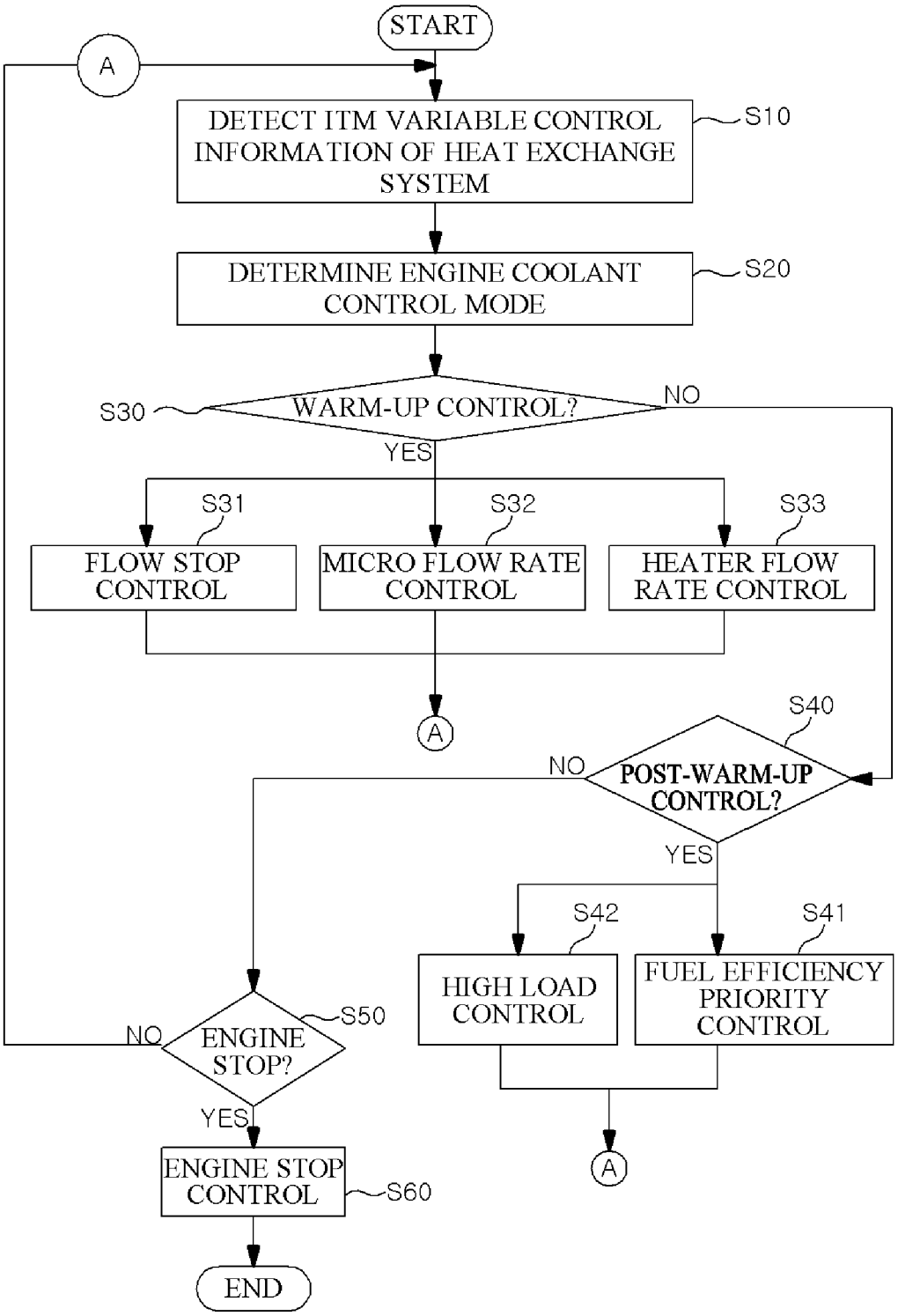
FIG. 4 is a flowchart illustrating an operation of a cooling circuit control method of the vehicle thermal management system to which the 2-port type integrated thermal management valve according to an exemplary embodiment of the present disclosure is applied.

Referring to FIG. 4, the cooling circuit control method of the vehicle thermal management system using the 2-port type ITM 1 may be configured to detect ITM variable control information of the heat exchange system by the valve controller 1000 (S10) to determine an engine coolant control mode (S20) and then perform a variable separation cooling valve control (S30 to S60).

Specifically, the valve controller 1000 may be configured to perform the detecting of the ITM variable control information of the heat exchange system (S10), and confirm, as input data, the IG on/off signals, the vehicle speed, the engine load, the engine temperature, the coolant temperature, the transmission oil temperature, the outside air temperature, the ITM operation signal, the accelerator/brake pedal signals, and the like provided from the information input device 1000-1 for the detecting of the ITM variable control information of the heat exchange system (S10). In addition, the valve controller 1000 may be configured to confirm the operating states of the heater core 200, the radiator 300, the EGR cooler 500, the oil warmer 600, the ATF warmer 700, and the EHRS 800 configuring the coolant circuits 100-1, 100-2, 100-3 of the VTMS 100 to confirm them as the operating information of the VTMS 100.

Subsequently, the valve controller 1000 may be configured to perform the determining of the engine coolant control mode (S20), and match the valve opening of the ITM 1 with the engine coolant temperature conditions with an ITM map of the variable separation cooling map 1000-2 using the input data of the information input device 1000-1 for the determining of the engine coolant control mode (S20). Accordingly, the valve controller 1000 applies, as operating conditions, the vehicle speed, the engine load, the engine temperature, the coolant temperature, the transmission oil temperature, the outside air temperature, and the like among the ITM variable control detection information to the determining of the engine coolant control mode (S20), and classifies the respective different operating conditions by the detected values thereof.

Further, the valve controller 1000 may enter into the variable separation cooling valve control (S30 to S60), and may be configured to classify the variable separation cooling valve control (S30 to S60) into a warm-up condition control (S30 to S33), a requirement control (S40 to S42), and an engine stop control (S50 and S60) according to an engine stop (for example, IG OFF). Particularly, the warm-up condition control (S30 to S33) and the requirement control (S40 to S42) classifies before and after the warm-up of the engine 110 using the transition conditions according to the operating conditions for the mode switching, such that by using the exhaust gas of the EHRS 800 upon the warm-up and bypassing the exhaust gas of the EHRS 800 after the warm-up is completed, it may be possible to minimize the amount of heat transfer to the coolant.

Accordingly, the warm-up condition control (S30 to S33) may use the exhaust gas of the EHRS 800 to contribute to the improvement of the heating performance of the heater while improving fuel efficiency by reducing the usage time point of the EHRS 800 even while simultaneously implementing the fast engine warm-up and the rapid oil warm-up (e.g., engine oil/transmission oil (ATF)).

For example, the valve controller 1000 may be configured to determine the need for the rapid warm-up using the warm-up control conditions (S30) with respect to the warm-up condition control (S30 to S40), and then may enter into one control step among the flow stop control (S31), the micro flow rate control (S32), and the heater flow rate control (S33) according to the operating conditions. In addition, the valve controller 1000 may be configured to determine the post warm-up control demand (S40) and then enter into one control step of the fuel efficiency priority control (S41) and the high load control (S42) according to the operating conditions with respect to the requirement control (S40 to S42).

For example, the valve controller 1000 may be configured to perform the engine stop control (S60) after determining the engine stop (S50) with respect to the engine stop control (S50 and S60). In particular, since the engine 110 is in the engine stop (IG off) state, the engine stop control (S60) may be switched to a state where the ITM 1 is open at the maximum cooling location by the valve controller 1000.

Figure 5:
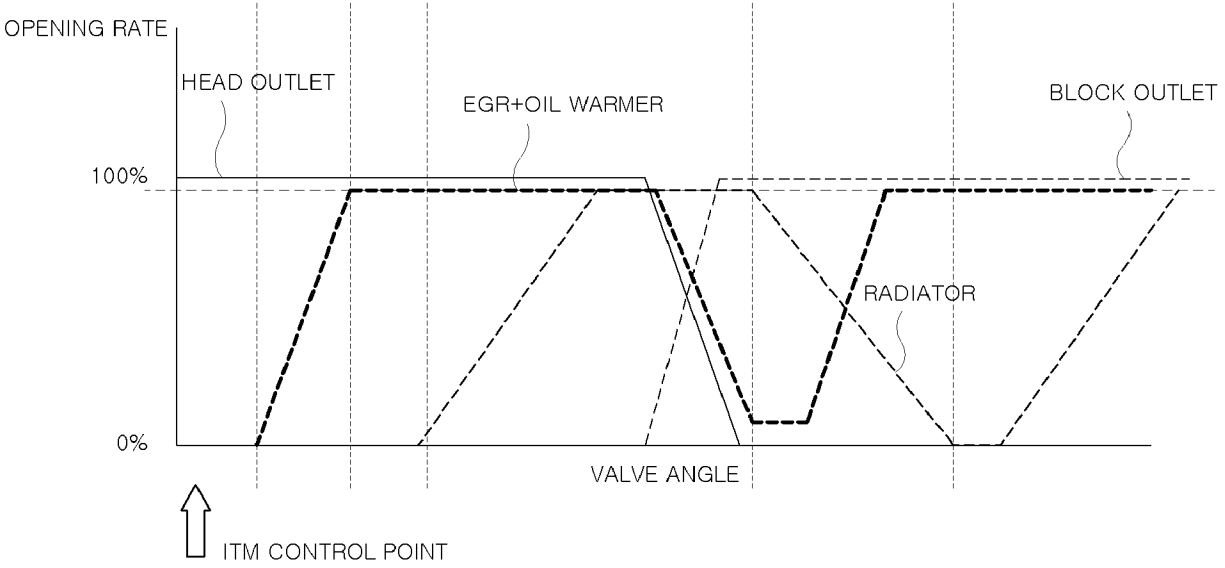
FIG. 5 is a valve opening and closing line diagram of the integrated thermal management valve in a flow stop control according to an exemplary embodiment of the present disclosure.
Figure 6:
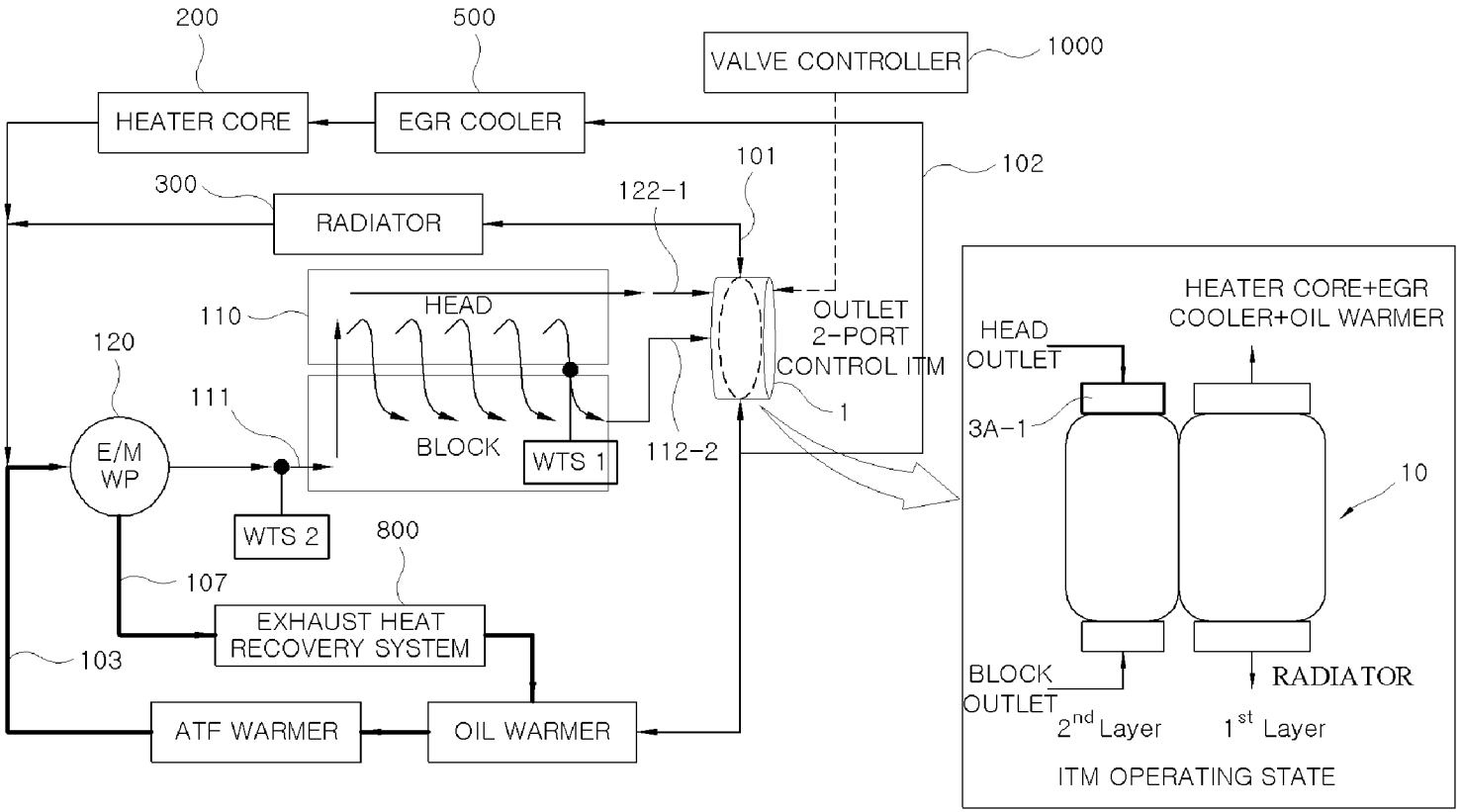
FIG. 6 is a diagram illustrating a state where the cooling circuit is operated in the flow stop control under warm-up conditions according to an exemplary embodiment of the present disclosure.

Hereinafter, the valve opening operation for the ITM 1 and the coolant distribution operations for the coolant circulation system 100-1/the first coolant distribution system 100-2/the second coolant distribution system 100-3 of the VTMS 100 in each of the flow stop control (S31), the micro flow rate control (S32), the heater flow rate control (S33), the fuel efficiency priority control (S41), and the high load control (S42) are as follows. FIGS. 5 and 6 illustrate the operating states of the ITM 1 and the cooling circuits 100-1, 100-2, 100-3 of the VTMS 100 and the valve opening and closing line diagram of the ITM 1 in the flow stop control (S31) under the warm-up conditions.

Referring to FIG. 5, in the flow stop control (S31), the valve opening of the ITM 1 may be adjusted by closing the heat exchanger outlet flow path 3B-1 and closing the radiator outlet flow path 3B-2 while opening the engine head coolant inlet 3A-1 and closing the engine block coolant inlet 3A-2. Accordingly, the ITM 1 may use the engine head coolant inlet 3A-1 of the engine 110 as an ITM control point.

Referring to FIG. 6, in the flow stop control (S31), the ITM 1 does not distribute the coolant, such that the first coolant flow path 101 of the coolant circulation system 100-1, the second coolant flow path 102 of the first coolant distribution system 100-2, and the third coolant flow path 103 of the second coolant distribution system 100-3 do not form the coolant flow.

However, the valve controller 1000 may be configured to operate the water pump 120 to bypass some of the coolant flowing into the engine 110 to the coolant branch flow path 107, and guide the bypassed coolant to the oil warmer 600 of the second coolant distribution system 100-3 with being heated by exchanging heat with the exhaust gas of the EHRS 800. Accordingly, the second coolant distribution system 100-3 may guide the bypassed coolant to the third coolant flow path 103 through the coolant branch flow path 107, and the oil warmer 600 and the ATF warmer 700 installed on the third coolant flow path 103 may exchange heat with the bypassed coolant heated by the exhaust gas.

As a result, the flow stop control (S31) may maintain a port close state for each of the radiator 300/the heater core 200/the EGR cooler 500, thereby implementing the rapid warm-up of the engine coolant and the fast warm-up of the engine 110 and in addition, supplies the heat amount of the EHRS 800 to the oil warmer 600 and the ATF warmer 700, thereby implementing the rapid warm-up of the engine and/or transmission oil. Particularly, the engine block outlet may be blocked by closing the engine block coolant inlet 3A-2 to minimize the coolant flow inside the block, thereby increasing the block temperature to improve the fuel efficiency.

Figure 7:
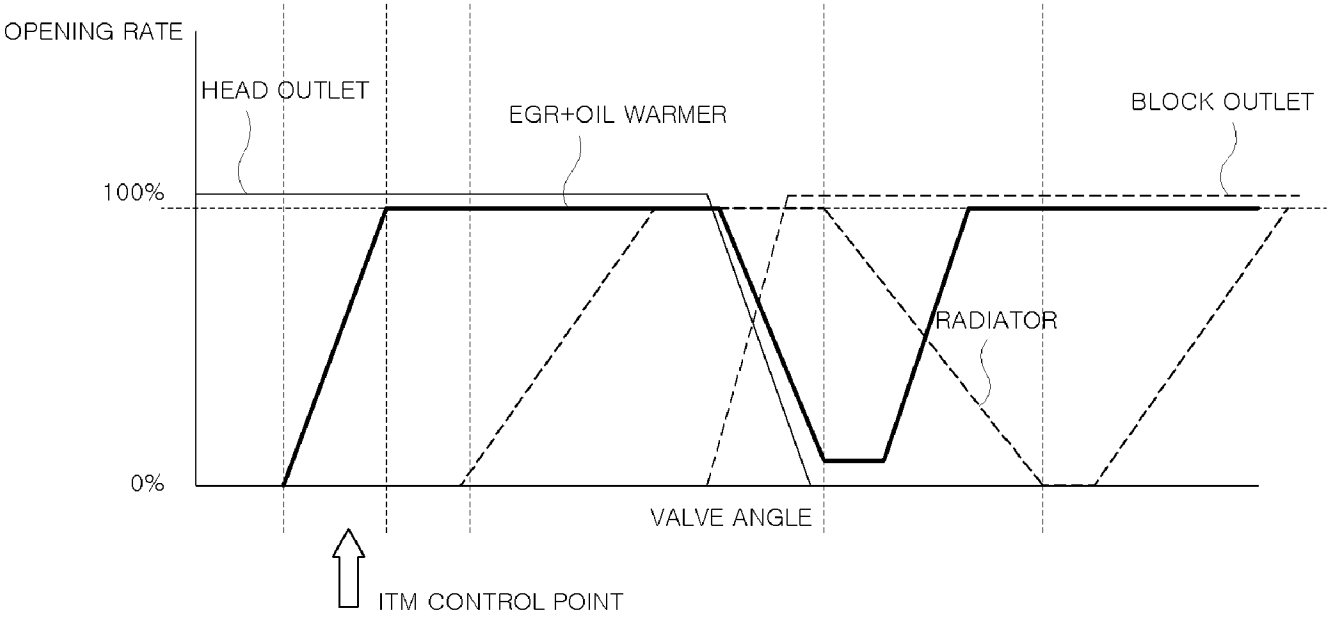
FIG. 7 is a valve opening and closing line diagram of the integrated thermal management valve in a micro flow rate control according to an exemplary embodiment of the present disclosure.
Figure 8:
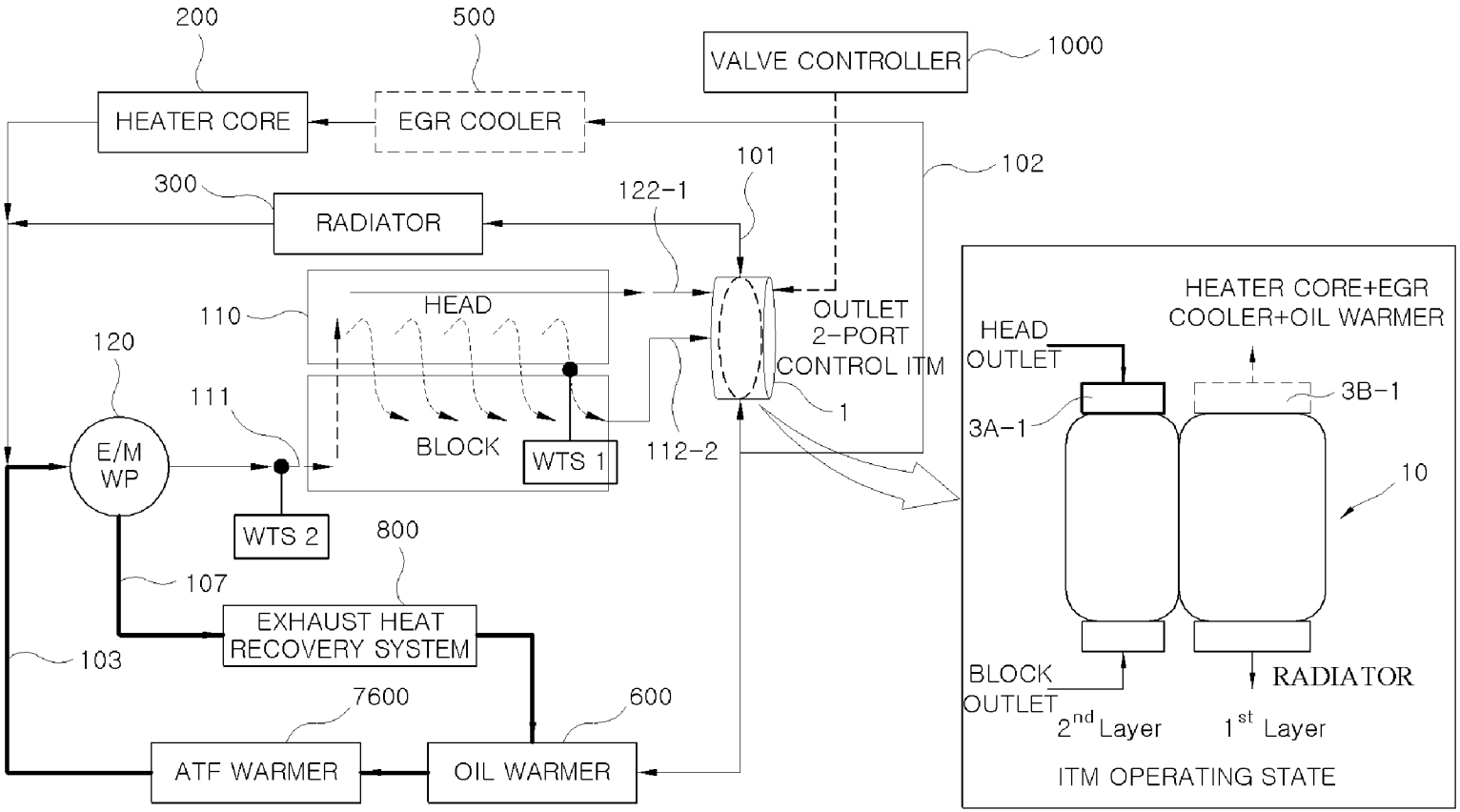
FIG. 8 is a diagram illustrating a state where the cooling circuit is operated in the micro flow rate control under the warm-up conditions according to an exemplary embodiment of the present disclosure.

FIGS. 7 and 8 illustrate the operating states of the ITM 1 and the cooling circuits 100-1, 100-2, 100-3 of the VTMS 100 and the valve opening and closing line diagram of the ITM 1 in the micro flow rate control (S32) under the warm-up conditions.

Referring to FIG. 7, in the micro flow rate control (S32), the valve opening of the ITM 1 may be adjusted by gradually and partially opening the heat exchanger outlet flow path 3B-1 and closing the radiator outlet flow path 3B-2 while opening the engine head coolant inlet 3A-1 and closing the engine block coolant inlet 3A-2. Accordingly, the ITM 1 may use the engine head coolant inlet 3A-1 of the engine 110 and the heat exchanger outlet flow path 3B-1 as ITM control points.

Referring to FIG. 8, in the micro flow rate control (S32), the ITM 1 gradually distributes some coolants, such that the coolant flow is not formed in the first coolant flow path 101 of the coolant circulation system 100-1 but the coolant flow in which some coolants of the entire coolant are gradually increased may be formed in each of the second coolant flow path 102 of the first coolant distribution system 100-2 and the third coolant flow path 103 of the second coolant distribution system 100-3.

However, the valve controller 1000 may be configured to operate the water pump 120 to bypass some of the coolant flowing into the engine 110 (e.g., a first amount of coolant) to the coolant branch flow path 107, and guides the bypassed coolant into the oil warmer 600 of the second coolant distribution system 100-3 with being heated by exchanging heat with the exhaust gas of the EHRS 800. Accordingly, the second coolant distribution system 100-3 may guide the bypassed coolant through the coolant branch flow path 107 together with the distribution coolant of the ITM 1 through the heat exchanger outlet flow path 3B-1 into the third coolant flow path 103, and the oil warmer 600 and the ATF warmer 700 installed on the third coolant flow path 103 may exchange heat with the coolant in which the distribution coolant and the bypassed coolant are joined.

As a result, the micro flow rate control (S32) may gradually open the port for each of the heater core 200/the EGR cooler 500/the oil warmer 600/the ATF warmer 700 while continuously closing the port for the radiator 300, thereby implementing the rapid warm-up of the engine coolant and the rapid warm-up of the engine 110 in the uniform temperature state and supplies the heat amount of the EHRS 800 to the oil warmer 600 and the ATF warmer 700, thereby implementing the rapid warm-up of the engine and/or the transmission oil. Particularly, the engine block outlet may be blocked by closing the engine block coolant inlet 3A-2 to minimize the coolant flow inside the block, thereby increasing the block temperature to improve the fuel efficiency.

Figure 9:
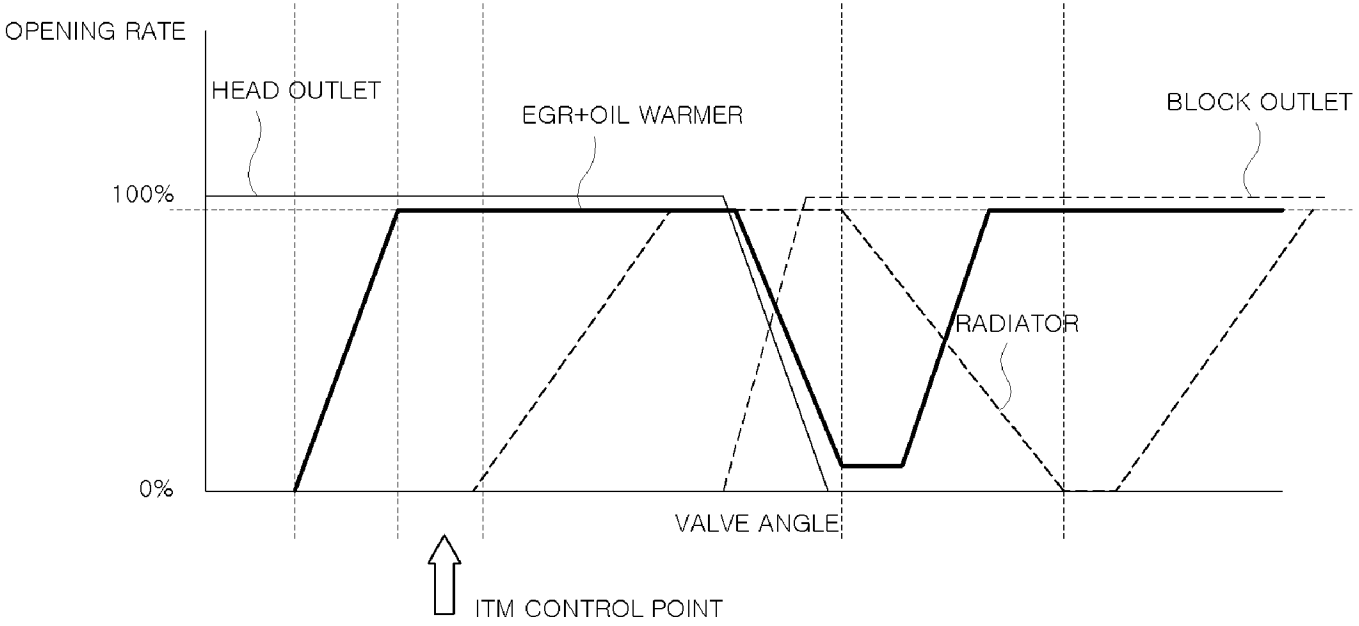
FIG. 9 is a valve opening and closing line diagram of the integrated thermal management valve in a heater flow rate control according to an exemplary embodiment of the present disclosure.
Figure 10:
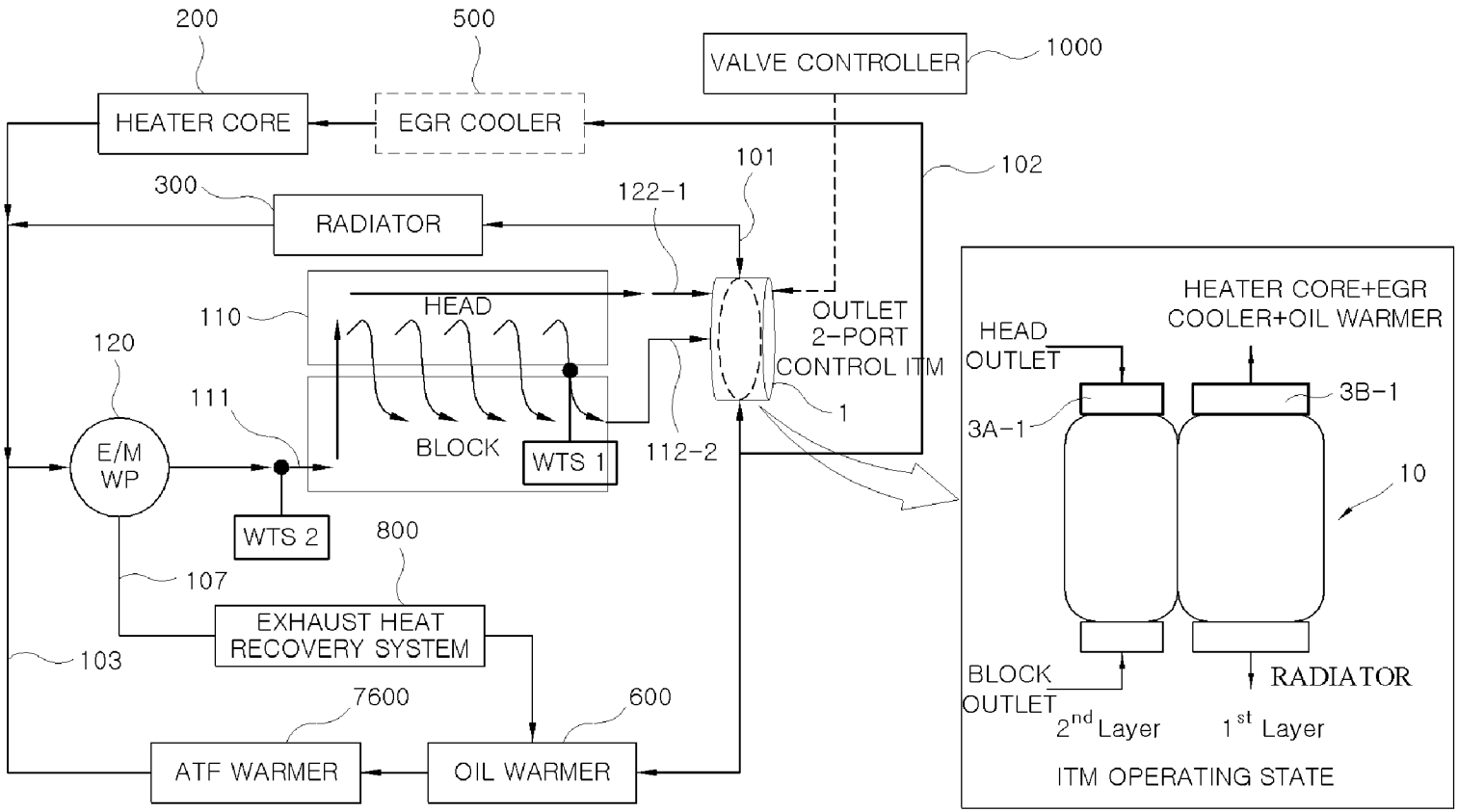
FIG. 10 is a diagram illustrating a state where the cooling circuit is operated in the heater flow rate control under the warm-up conditions according to an exemplary embodiment of the present disclosure.

FIGS. 9 and 10 illustrate the operating states of the ITM 1 and the cooling circuits 100-1, 100-2, 100-3 of the VTMS 100 and the valve opening and closing line diagram of the ITM 1 in the heater flow rate control (S33) under the warm-up conditions.

Referring to FIG. 9, in the heater flow rate control (S33), the valve opening of the ITM 1 may be adjusted by completely opening the heat exchanger outlet flow path 3B-1 and closing the radiator outlet flow path 3B-2 while opening the engine head coolant inlet 3A-1 and closing the engine block coolant inlet 3A-2. Accordingly, the ITM 1 may use the engine head coolant inlet 3A-1 of the engine 110 and the heat exchanger outlet flow path 3B-1 as ITM control points.

Referring to FIG. 10, in the heater flow rate control (S33), the ITM 1 may partially restrict the coolant distribution, such that the coolant flow is not formed in the first coolant flow path 101 of the coolant circulation system 100-1 but sufficient coolant flow may be formed in each of the second coolant flow path 102 of the first coolant distribution system 100-2 and the third coolant flow path 103 of the second coolant distribution system 100-3.

On the other hand, the valve controller 1000 may be configured to stop operation of the water pump 120, such that the EHRS 800 bypasses the exhaust gas, thereby not performing a separate oil warm-up function by the bypassed coolant while minimizing the amount of heat transfer to the coolant. Accordingly, the second coolant distribution system 100-3 may guide only the distribution coolant of the ITM 1 through the heat exchanger outlet flow path 3B-1 to the third coolant flow path 103, and the oil warmer 600 and the ATF warmer 700 installed on the third coolant flow path 103 may exchange heat with the distribution coolant.

As a result, the heater flow rate control (S33) may completely open the port for each of the heater core 200/the EGR cooler 500/the oil warmer 600/the ATF warmer 700 while continuously closing the port for the radiator 300, such that the engine 110 secures the sufficient coolant flow rate for the heater core 200 and the EGR cooler 500 while becoming the warm-up completed state to prevent any issues with heating performance. Particularly, the engine block outlet may be blocked by closing the engine block coolant inlet 3A-2 to minimize the coolant flow inside the block, thereby increasing the block temperature to improve the fuel efficiency.

Figure 11:
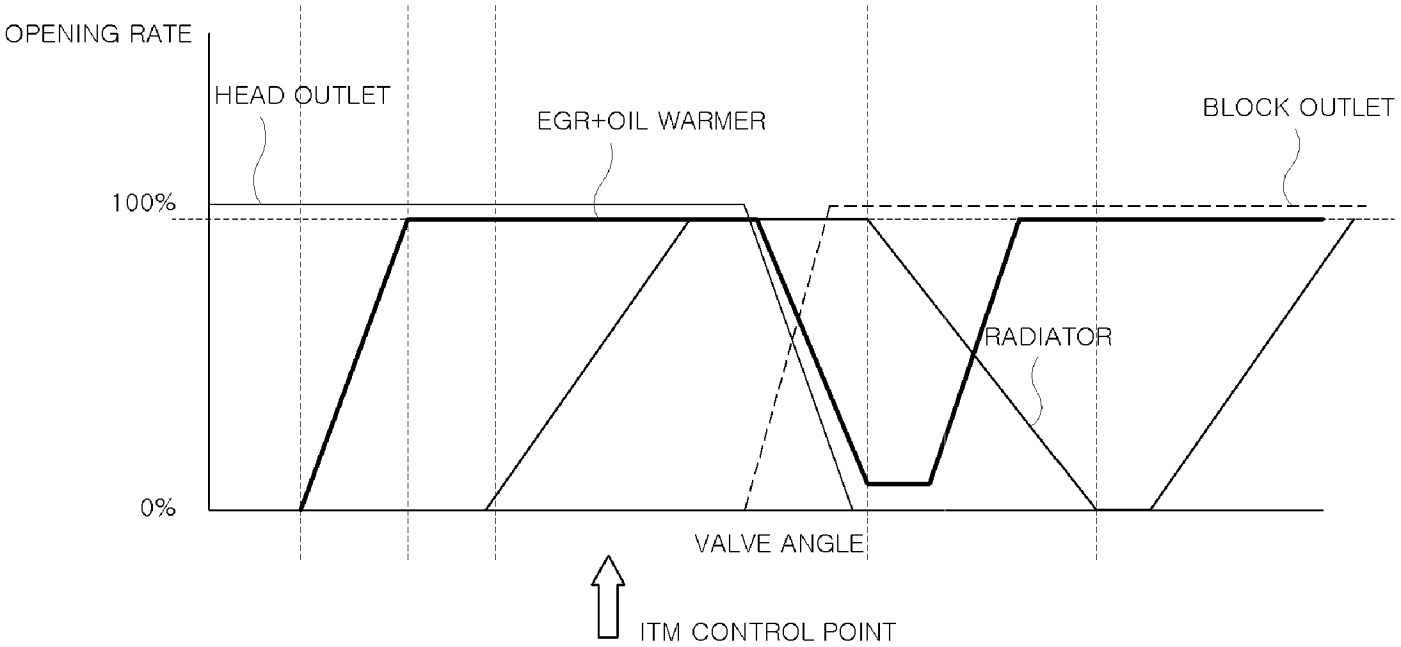
FIG. 11 is a valve opening and closing line diagram of the integrated thermal management valve in a fuel efficiency priority control according to an exemplary embodiment of the present disclosure.
Figure 12:
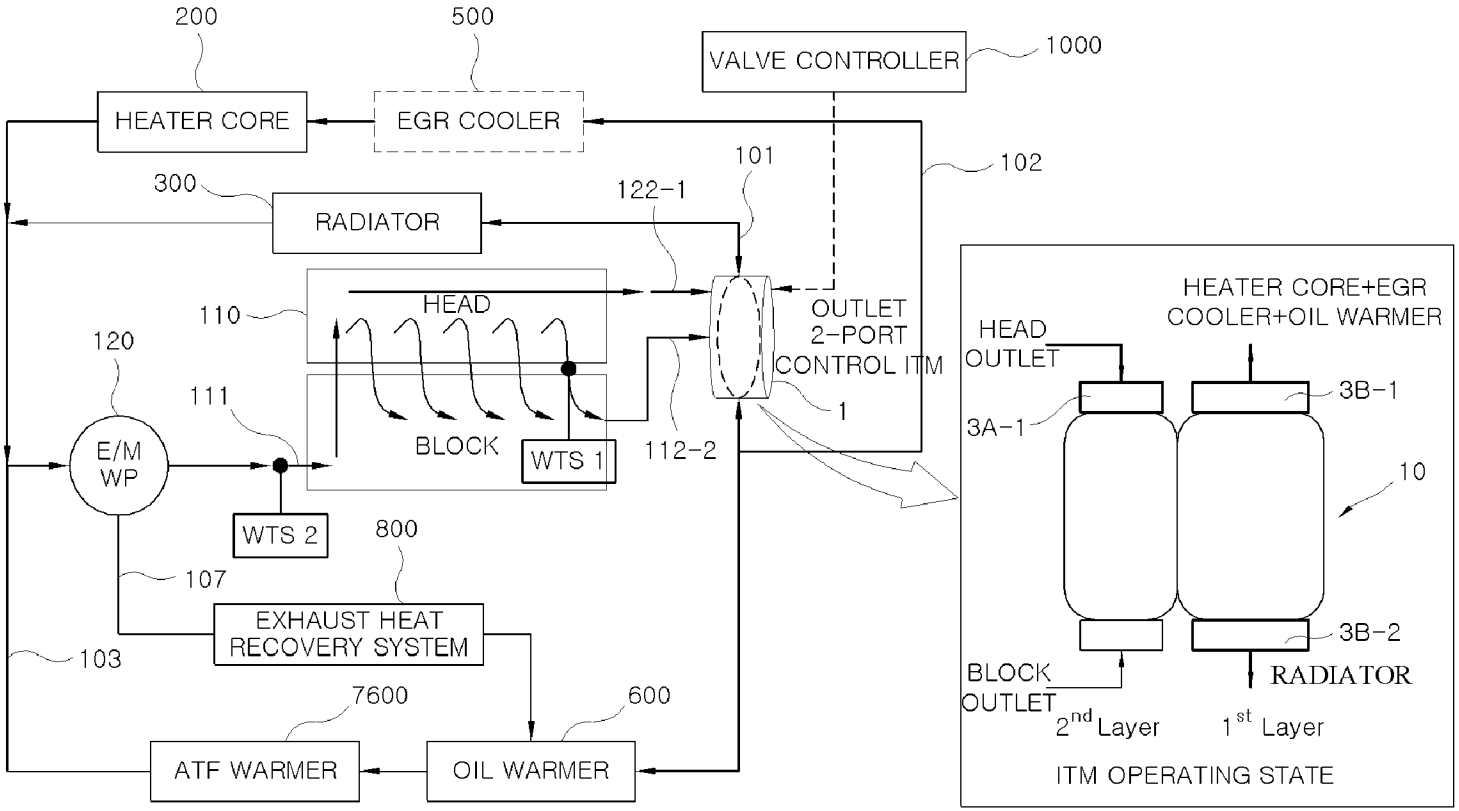
FIG. 12 is a diagram illustrating a state where the cooling circuit is operated in the fuel efficiency priority control under conditions other than the warm-up according to an exemplary embodiment of the present disclosure.

FIGS. 11 and 12 illustrate the operating states of the ITM 1 and the cooling circuits 100-1, 100-2, 100-3 of the VTMS 100 and the valve opening and closing line diagram of the ITM 1 in the fuel efficiency priority control (S41) under conditions other than the warm-up.

Referring to FIG. 11, in the fuel efficiency priority control (S41), the valve opening of the ITM 1 may be adjusted by completely opening the heat exchanger outlet flow path 3B-1 and gradually and partially opening the radiator outlet flow path 3B-2 while opening the engine head coolant inlet 3A-1 and closing the engine block coolant inlet 3A-2. Accordingly, the ITM 1 may use the engine head coolant inlet 3A-1 of the engine 110, the heat exchanger outlet flow path 3B-1, and the radiator outlet flow path 3B-2 as ITM control points.

Referring to FIG. 12, in the fuel efficiency priority control (S41), the ITM 1 entirely distributes the coolant, to gradually form the coolant flow in the first coolant flow path 101 of the coolant circulation system 100-1 and sufficient coolant flow may be formed in each of the second coolant flow path 102 of the first coolant distribution system 100-2 and the third coolant flow path 103 of the second coolant distribution system 100-3.

On the other hand, the valve controller 1000 may be configured to stop operation of the water pump 120, such that the EHRS 800 bypasses the exhaust gas, thereby not performing a separate oil warm-up function by the bypassed coolant while minimizing the amount of heat transfer to the coolant. Accordingly, the second coolant distribution system 100-3 may guide only the distribution coolant of the ITM 1 through the heat exchanger outlet flow path 3B-1 to the third coolant flow path 103, and the oil warmer 600 and the ATF warmer 700 installed on the third coolant flow path 103 may exchange heat with the distribution coolant.

As a result, the fuel efficiency priority control (S41) may obtain the following effects.

Firstly, the temperature of the second WTS 130-2 at the engine outlet side may be adjusted by partially opening the port at the radiator 300 side under the variable control of the valve controller 1000 for the radiator outlet flow path 3B-2. Secondly, by completely opening the port for each of the heater core 200/the EGR cooler 500/the oil warmer 600/the ATF warmer 700, the engine 110 controls to sufficiently secure the coolant flow rates for the heater core 200 and the EGR cooler 500 while becoming the warm-up completed state to prevent any issues with heating performance. Thirdly, the engine block outlet may be operated to be blocked by closing the engine block coolant inlet 3A-2 to minimize the coolant flow inside the block, thereby increasing the block temperature to improve the fuel efficiency.

Figure 13:
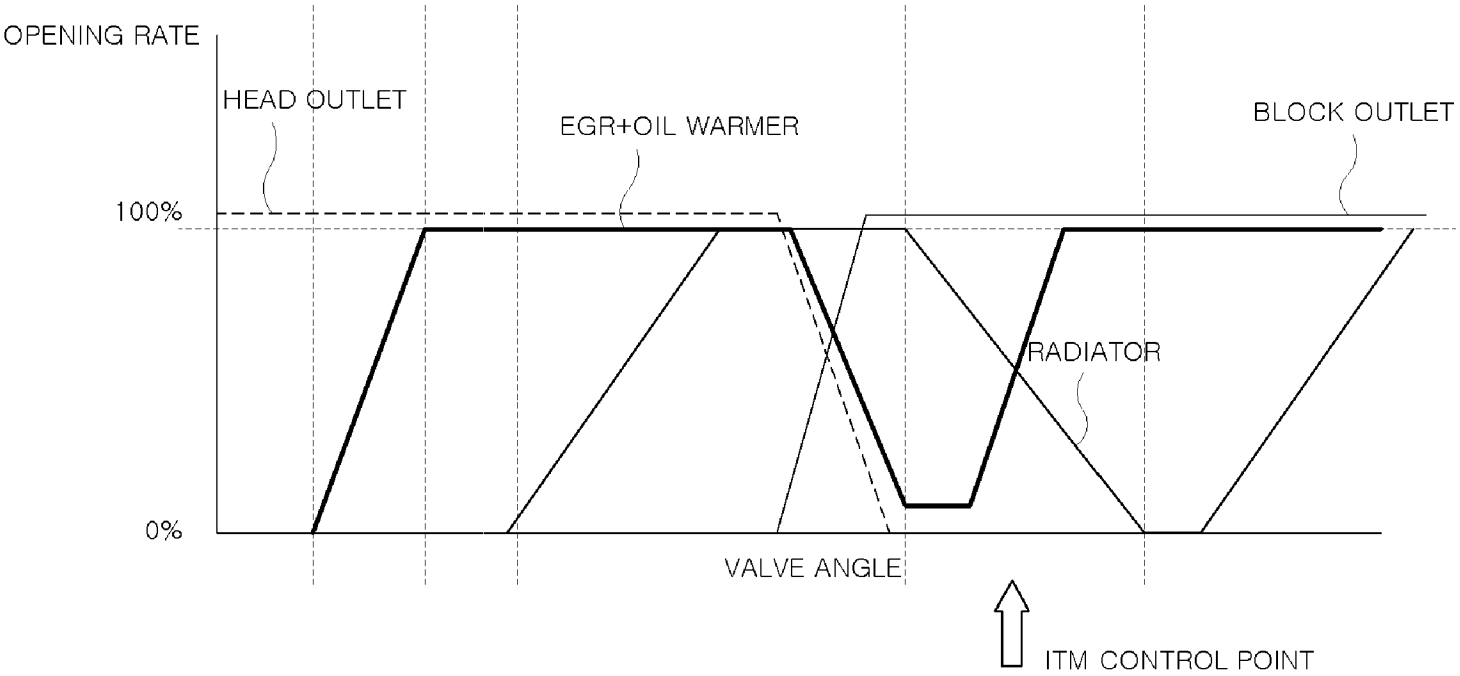
FIG. 13 is a valve opening and closing line diagram of the integrated thermal management valve in a high load control according to an exemplary embodiment of the present disclosure.
Figure 14:
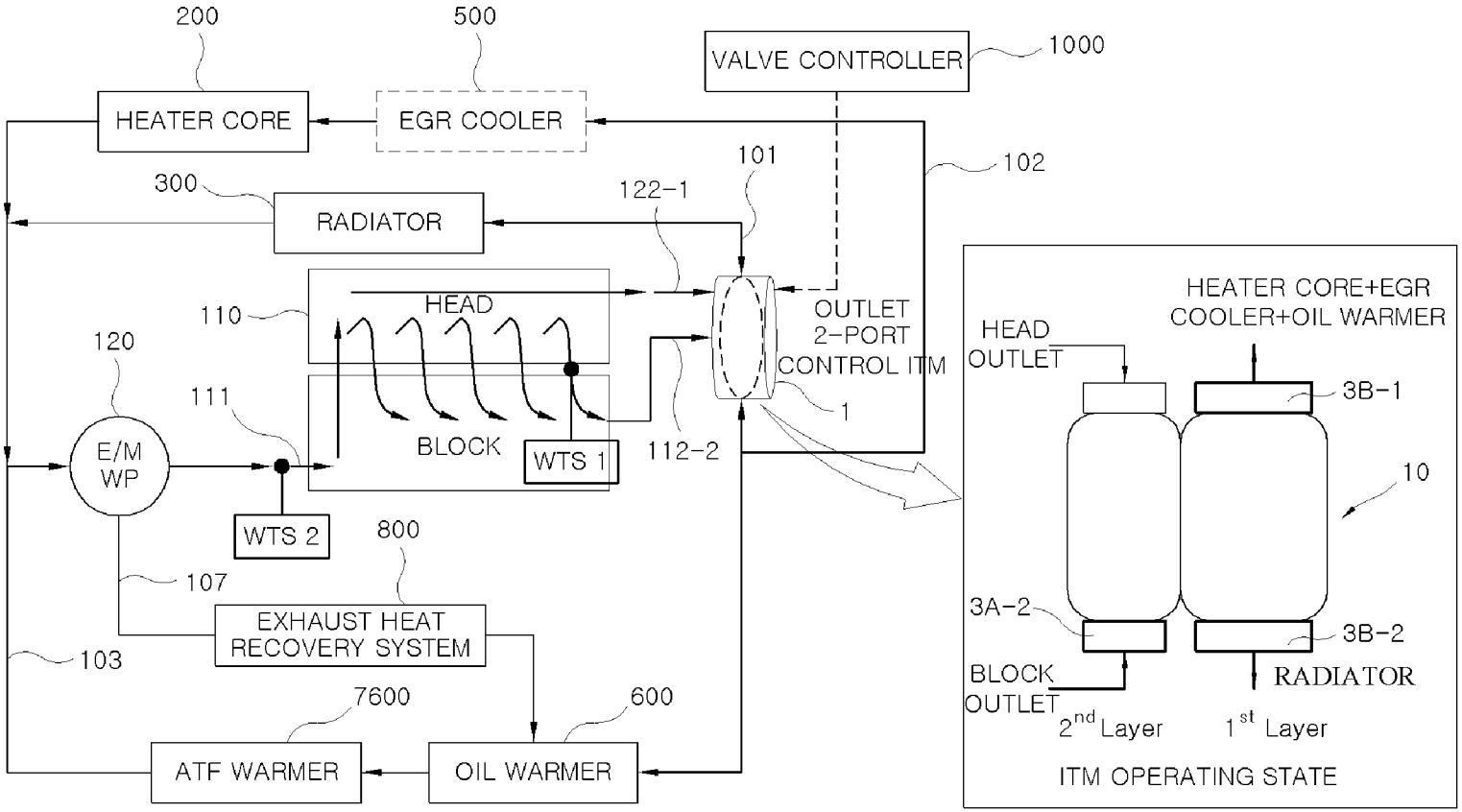
FIG. 14 is a diagram illustrating a state where the cooling circuit is operated in the high load control under conditions other than the warm-up according to an exemplary embodiment of the present disclosure.

FIGS. 13 and 14 illustrate the operating states of the ITM 1 and the cooling circuits 100-1, 100-2, 100-3 of the VTMS 100 and the valve opening and closing line diagram of the ITM 1 in the high load control (S42) under conditions other than the warm-up.

Referring to FIG. 13, in the high load control (S42), the valve opening of the ITM 1 may be adjusted by completely opening the heat exchanger outlet flow path 3B-1 and completely opening the radiator outlet flow path 3B-2 while closing the engine head coolant inlet 3A-1 and opening the engine block coolant inlet 3A-2. Accordingly, the ITM 1 may use the engine block coolant inlet 3A-2 of the engine 110, the heat exchanger outlet flow path 3B-1, and the radiator outlet flow path 3B-2 as ITM control points.

Referring to FIG. 14, in the high load control (S42), the ITM 1 entirely distributes the coolant, such that the sufficient coolant flow may be formed in the first coolant flow path 101 of the coolant circulation system 100-1 and sufficient coolant flow may also be formed in each of the second coolant flow path 102 of the first coolant distribution system 100-2 and the third coolant flow path 103 of the second coolant distribution system 100-3.

On the other hand, the valve controller 1000 may be configured to stop operation of the water pump 120, such that the EHRS 800 bypasses the exhaust gas, thereby not performing a separate oil warm-up function by the bypassed coolant while minimizing the amount of heat transfer to the coolant. Accordingly, the second coolant distribution system 100-3 may guide only the distribution coolant of the ITM 1 through the heat exchanger outlet flow path 3B-1 to the third coolant flow path 103, and the oil warmer 600 and the ATF warmer 700 installed on the third coolant flow path 103 may exchange heat with the distribution coolant.

As a result, the high load control (S42) may obtain the following effects.

Firstly, by completely opening the port at the radiator 300 side under the variable control of the valve controller 1000 for the radiator outlet flow path 3B-2, the temperature of the second WTS 130-2 at the engine outlet side may be adjusted, and accordingly, the temperature of the engine 110 may be reduced at the high speed/high load operations. Secondly, by completely opening the port for each of the heater core 200/the EGR cooler 500/the oil warmer 600/the ATF warmer 700, the engine 110 may be operated to secure the sufficient coolant flow rate for the heater core 200 and the EGR cooler 500 while becoming the warm-up completed state to prevent issues with heating performance. Thirdly, the engine block outlet may be opened by opening the engine block coolant inlet 3A-2 to implement the block temperature and the flow pattern of the head by the full cross flow, thereby performing a control of prioritizing performance and durability by reducing the fluctuation and level of the temperature of a combustion chamber.

Meanwhile, the valve controller 1000 may maintain the heat exchange outlet flow path 3B-1 as a full open state during a particularly period of time with respect to the valve opening of the ITM 1 until before starting the heater flow rate control (S33) in the micro flow rate control (S32) or in any one of the micro flow rate control (S32), the heater flow rate control (S33), the fuel efficiency priority control (S41), and the high load control (S42), changes the heat exchanger outlet flow path 3B-1 to a close state when entering into the switching range formed by the engine head coolant inlet 3A-1 and the engine block coolant inlet 3A-2, and may maintain the heat exchanger outlet flow path 3B-1 as a full close state during a particular period of time when the switching range elapses.

As described above, the vehicle thermal management system 100 according to the present exemplary embodiment is configured so that the engine coolant of the engine 110 flowing through the heater core 200, the radiator 300, the EGR cooler 500, the oil warmer 600, the ATF warmer 700, and the EHRS 800 applied to a plurality of cooling circuits 100-1, 100-2, 100-3 as heat exchangers may form the optional coolant flow under the valve opening control of the ITM 1, and particularly, supplies the heat amount to the coolant flowing into the oil warmer 600 by the exhaust gas of the EHRS 800, such that the outlet port of the ITM 1 for adjusting the coolant before and after the warm-up may be adjusted by the two outlet ports 3B-1, 3B-2 by the one layer ball 10 to reduce the size of the ITM 1 and reduce the costs thereof for optimizing the configuration of the cooling circuit, thereby enhancing the vehicle mountability while improving the price competitiveness.

What is claimed is:

1. A vehicle thermal management system comprising:

an integrated thermal management valve (ITM) for receiving coolant through a coolant inlet connected to an engine coolant outlet of an engine, and distributing the coolant flowing out through a coolant outlet flow path to a radiator together with a heat exchange system including at least one among a heater core, an exhaust gas recirculation (EGR) cooler, an oil warmer, and an auto transmission fluid (ATF) warmer;

a water pump disposed at the front end of an engine coolant inlet of the engine;

a coolant branch flow path branched at the front end of the engine coolant inlet and connected to the oil warmer; and a valve controller configured to control a valve opening control of the integrated thermal management valve (ITM), wherein the engine coolant inlet is connected to the outlet end of the water pump by a first coolant line of the engine cooling system, wherein an exhaust heat recovery system (EHRS) is disposed in the coolant branch flow path connected to the oil warmer, and wherein the valve controller performs a coolant bypass flow of the coolant branch flow path joined to the oil warmer and the auto transmission fluid (ATF) warmer through the EHRS under a driving control of the water pump.

2. The vehicle thermal management system of claim 1, wherein the ITM embeds one layer ball, and wherein the layer ball includes a first layer which forms the coolant outlet flow path as two outlet ports, and a second layer which forms the coolant inlet as two inlet ports.

3. The vehicle thermal management system of claim 1, wherein the coolant outlet flow path includes a heat exchanger outlet flow path connected to the heat exchanger, and a radiator outlet flow path connected to the radiator.

4. The vehicle thermal management system of claim 3, wherein the heat exchanger outlet flow path is branched to two flow paths to be connected to the oil warmer or the ATF warmer while being connected to the heater core or the EGR cooler, and the coolant coming from the heat exchanger outlet flow path is distributed to the two flow paths.

5. The vehicle thermal management system of claim 1, wherein the engine coolant outlet is classified into an engine head coolant outlet and an engine block coolant outlet, and wherein the coolant inlet is classified into an engine head coolant inlet connected to the engine head coolant outlet and an engine block coolant inlet connected to the engine block coolant outlet.

6. The vehicle thermal management system of claim 5, wherein the valve opening of the ITM is operated so that the openings or closings of the engine head coolant inlet and the engine block coolant inlet are opposite to each other.

7. The vehicle thermal management system of claim 6, wherein the opening of the engine head coolant inlet forms a parallel flow in which the coolant is discharged to the engine head coolant outlet inside the engine, and wherein the opening of the engine block coolant inlet forms a cross flow in which the coolant is discharged to the engine block coolant outlet.

8. A cooling circuit control method of a vehicle thermal management system, comprising:

supplying coolant of an engine cooling system to an engine through an engine coolant inlet that is connected to an outlet end of a water pump by a first coolant line of the engine cooling system;

guiding coolant of the engine circulated from an integrated thermal management valve (ITM) to the water pump and a radiator through an engine head coolant inlet and an engine block coolant inlet, the coolant flowing out toward the radiator through a radiator outlet flow path is distributed, the coolant flowing out toward heat exchangers including one or more among a heater core, an EGR cooler, an oil warmer, an ATF warmer, and an exhaust heat recovery system (EHRS) through a heat exchanger outlet flow path is distributed, and a coolant branch flow path connected to the water pump is connected to the oil warmer, supplying to the exhaust heat recovery system (EHRS) a coolant flow to the coolant branch flow path, and regulating the coolant flow with respect to the oil warmer, and performing an engine coolant control mode of the vehicle thermal management system including any one of a flow stop control, a micro flow rate control, a heater flow rate control, a fuel efficiency priority control, and a high load control under a valve opening control of the ITM by a valve controller, wherein the valve controller is configured to perform a coolant bypass flow of the coolant branch flow path joined to the oil warmer and the auto transmission fluid (ATF) warmer through the EHRS under a driving control of the water pump in the warm-up conditions.

9. The cooling circuit control method of the vehicle thermal management system of claim 8, wherein in the flow stop control, the ITM is configured to open the engine head coolant inlet while closing all of the engine block coolant inlet, the heat exchanger outlet flow path, and the radiator outlet flow path.

10. The cooling circuit control method of the vehicle thermal management system of claim 8, wherein in the micro flow rate control, the ITM is configured to partially open the heat exchanger outlet flow path while opening the engine head coolant inlet and closing both the engine block coolant inlet and the radiator outlet flow path.

11. The cooling circuit control method of the vehicle thermal management system of claim 8, wherein in the heater flow rate control, the ITM is configured to open both the engine head coolant inlet and the heat exchanger outlet flow path while closing both the engine block coolant inlet and the radiator outlet flow path.

12. The cooling circuit control method of the vehicle thermal management system of claim 8, wherein in the fuel efficiency priority control, the ITM is configured to open both the engine head coolant inlet and the heat exchanger outlet flow path while partially opening the radiator outlet flow path and closing the engine block coolant inlet.

13. The cooling circuit control method of the vehicle thermal management system of claim 8, wherein in the high load control, the ITM is configured to close the engine head coolant inlet while opening all of the engine block coolant inlet, the heat exchanger outlet flow path, and the radiator outlet flow path.

14. The cooling circuit control method of the vehicle thermal management system of claim 8, wherein the flow stop control, the micro flow rate control, the heater flow rate control, the fuel efficiency priority control, and the high load control are determined by operating conditions of vehicle operating information.

15. The cooling circuit control method of the vehicle thermal management system of claim 8, wherein the valve controller is configured to open the valve opening of the ITM to the maximum cooling location when an engine is stopped.

16. The cooling circuit control method of the vehicle thermal management system of claim 8, wherein the ITM is configured to maintain the heat exchanger outlet flow path as a full open state during a particular period of time with respect to any one of the micro flow rate control, the heater flow rate control, the fuel efficiency priority control, and the high load control.

17. The cooling circuit control method of the vehicle thermal management system of claim 16, wherein the ITM is configured to change the heat exchanger outlet flow path to a close state when entering into a switching range formed by the engine head coolant inlet and the engine block coolant inlet.

18. The cooling circuit control method of the vehicle thermal management system of claim 17, wherein the ITM is configured to maintain the heat exchanger outlet flow path as a full close state during a particular period of time when the switching range elapses.

* * * * *